US006292647B1

(12) United States Patent
Ishida

(10) Patent No.: US 6,292,647 B1
(45) Date of Patent: Sep. 18, 2001

(54) HEATING MECHANISM FOR USE IN IMAGE FORMING APPARATUS

(75) Inventor: Haruhiko Ishida, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/590,244

(22) Filed: Jun. 8, 2000

(51) Int. Cl.[7] ..... G03G 15/20

(52) U.S. Cl. ..... 399/330; 219/216; 219/469; 219/619; 399/321; 399/328

(58) Field of Search ..... 399/328, 320, 399/330, 321; 219/216, 619, 671, 672, 674, 675, 634, 469

(56) References Cited

U.S. PATENT DOCUMENTS

| | | | | |
|---|---|---|---|---|
| 5,713,069 | * | 1/1998 | Kato | 399/330 |
| 5,752,150 | | 5/1998 | Kato et al. | 399/330 |
| 5,822,669 | | 10/1998 | Okabayashi et al. | 399/330 |
| 6,049,691 | * | 4/2000 | Abe et al. | 399/330 |
| 6,181,905 | * | 1/2001 | Ohta et al. | 399/328 |
| 6,198,901 | * | 3/2001 | Watanabe | 399/328 |

FOREIGN PATENT DOCUMENTS

| | | | |
|---|---|---|---|
| 63-85776 | * | 4/1988 | (JP) . |
| 8-76620 | | 3/1996 | (JP) . |
| 9-106207 | | 4/1997 | (JP) . |
| 9-258586 | | 10/1997 | (JP) . |

* cited by examiner

*Primary Examiner*—Susan S. Y. Lee
(74) *Attorney, Agent, or Firm*—Foley & Lardner

(57) ABSTRACT

A fixing device includes a first rotation member formed hollow cylindrical and rotatable in a predetermined direction, a second rotation member brought into contact with the first rotation member at a predetermined pressure, so as to be rotated as the first rotation member rotates, creating a contact section with the first rotation member, through which an object to be heated can pass, a first induction heating device, provided within the first rotation member, for applying an alternating magnetic field which is in parallel with a circumferential direction of the first rotation member, onto the first rotation member, and a second induction heating device, provided within the first rotation member such as to surround an outer section of a part of the first induction heating device, and be close to both end portions of the first rotation member, for applying an alternating magnetic field which is in parallel with a circumferential direction of the first rotation member, onto the first rotation member, the fixing device heating the output image holding medium on which the first and second toner images have been transformed, and the toners which form the toner images, thereby fixing the toner on the output image holding medium.

16 Claims, 4 Drawing Sheets

HEATING MECHANISM FOR USE IN IMAGE FORMING APPARATUS

BACKGROUND OF THE INVENTION

The present invention relates to a heating device which utilizes induction heating, and more specifically, to a fixing device for fixing a toner image, which is used in an electronic photographic type color copier, color printer or the like, which uses toner as an image visualizing agent.

In a color copier or a color printer, of the electronic photographic type, a fixing device for fixing an output image, that is, a toner image, onto a sheet, is used, and the device employs the following popular method, that is, a metal cylinder within which a heat source such as a halogen lamp is disposed, is heated by the heat source with radiated heat, and the heat, maintained in the metal cylinder, is propagated to a sheet and a toner image (toner), so as to fix the toner (toner image) onto the sheet.

In the fixing device of the above-described type, an elastic roller member is pressed at a predetermined pressure onto a metal roller containing a halogen lamp within itself, and a sheet onto which a toner image is statically adhered is made to pass between these rollers, so as to heat the toner and sheet and at the same time, apply a predetermined pressure thereto. In this manner, part of the toner melted by the heat is fixedly attached to the sheet, and at the same time, toner particles which are not in contact with the sheet are bonded together, thus fixing the toner (toner image) onto the sheet.

However, in the fixing device which utilizes a halogen lamp, such as described above, the light and infrared radiation are radiated onto the metal roller from all circumferential directions as well as the longitudinal direction (that is, the axial direction), and thus the entire roller is heated. Therefore, in consideration of the loss of energy resulting when light is converted into heat, and the efficiency for propagating heat to the roller by heating the air within the roller, etc., the heat exchange efficiency is only 60 to 70%. Thus, the heat efficiency is at such a low level, and therefore a lot of energy is required. Further, it may take even several minutes in order to increase the temperature of the outer circumferential surface of the metal roller to a predetermined level.

Under these circumstances, recently there has been proposed a fixing device, in which a heating member and a film with a cylindrical form and having a heat resisting property, which can be conveyed as it is tightly attached to the heating member, are used. In this device, a material to be heated is tightly attached to a film, and it is conveyed together with the film, so as to impart the heat energy of the heating member, from the film to the material to be heated.

With regard to the fixing device using such a film, as described above, it is essential to maintain the temperature of the heating member uniformly in the longitudinal direction, and therefore the uniformity of the thermal characteristics of the fixing device is required in the manufacture process and high-efficiency temperature control is required in the operation. Therefore, the production cost for the device is inevitably increased.

In addition, in high-speed copiers which process a great number of copies per unit time, the heating time is shorter than usual types, and therefore the heating member must be of a high quantity type (large capacity), which requires a much higher consumption power. Further, as the total power consumption becomes excessively large, which easily causes a problem in terms of safety standards.

In order to solve such problems entailed in the fixing operation using the heater, or using of a film, so far, there have been proposed fixing devices which utilize an induction heating method, as discussed in Jpn. Pat. Appln. KOKAI Publication No. H09-258586, H09-106207, H08-77620 and the like.

Jpn. Pat. Appln. KOKAI Publication No. H09-258586 discloses a fixing device operating on such a method that an electrical current is made to flow through the induction coil prepared by winding a coil wire around a core provided along the rotation shaft of the metal roller, and thus an induction current is generated in the roller, thus making the metal roller to generate heat from itself.

Jpn. Pat. Appln. KOKAI Publication No. H09-106207 discloses a fixing device of an induction heating type, a plurality of induction coils are set in a longitudinal direction within a metal roller made of a thin material, such that two coils located in a central portion are connected in parallel, and coils at both ends are connected in series with respect to the coils at the center, thus increasing the amount of heat generation at both ends of the metal roller.

Jpn. Pat. Appln. KOKAI Publication No. H08-76620 discloses a fixing device consisting of an electro-conductive film in which magnetic field generating means is contained, and a pressure roller brought in tight contact with the electro-conductive film, in which the electro-conductive film is made to generate heat, and thereby toner on a recording medium is fixed thereon as the medium is conveyed between the conductive film and the pressure roller.

It should be noted here that in the fixing device of the induction heating type, the temperature of the end portions of the heat (metal) roller is known to become lower than that of the central portion. Further, the length of the heat roller is specifically determined in accordance with the width of a sheet having the maximum size copyable. As a result, when copying is repeated continuously with sheets of a smaller width, the temperature of the central portion of the temperature distribution in the longitudinal direction of the roller becomes lower.

As discussed in its specification, the technique of Jpn. Pat. Appln. KOKAI Publication No. H09-106207 makes it possible to suppress the temperature of the end portion of the metal roller decreasing to a level lower than the temperature of the central portion.

However, in the case where the entire region of the roller in the longitudinal direction is maintained all times at a constant temperature, it is inevitable that heat is applied to unnecessary excessive portions on both ends of the roller while copying is continued on sheets of a small width, which is nothing but a waste of energy.

BRIEF SUMMARY OF THE INVENTION

The present invention is directed to a fixing device for an image forming apparatus which utilizes induction heating, and a first object thereof is to provide a fixing device capable of heating the heat roller such that the temperature distribution thereof in the longitudinal direction uniform.

Another object of the present invention is to provide a fixing device capable of controlling the length of the heat generating portion in the longitudinal direction of the heating roller in accordance with the width (size) of a medium on which an image is transferred, which is used for image forming.

Thus, according to the present invention, there is provided a fixing device comprising:

a first rotation member having a hollow cylindrical form, to be rotatable in a predetermined direction;

a second rotation member brought into contact with the first rotation member at a predetermined pressure, so as to be rotated as the first rotation member rotates, creating a contact section with the first rotation member, through which an object to be heated can pass;

a first induction heating device, provided within the first rotation member, for applying an alternating magnetic field which is in parallel with a circumferential direction of the first rotation member, onto the first rotation member; and a second induction heating device, provided within the first rotation member such as to surround an outer section of a part of the first induction heating device, and be close to both end portions of the first rotation member, for applying an alternating magnetic field which is in a direction parallel to an axial line of the first rotation member, onto the first rotation member.

Further, according to the present invention, there is provided a color image forming apparatus comprising:

a first image forming mechanism for forming a first toner image by selectively supplying a toner of a first color onto a first photosensitive drum and a latent image formed on the first photosensitive drum;

a second image forming mechanism for forming a second toner image by selectively supplying a toner of a second color, which is different from the toner of the first color, onto a second photosensitive drum and a latent image formed on the second photosensitive drum;

an output image holding medium conveying belt for holding an output image holding medium and conveying the output image holding medium from the first image forming mechanism towards the second image forming mechanism such that the first and second toner images formed by the first and second image forming mechanisms, respectively are made transferable onto the output image holding medium;

a first transfer device, provided at such a position that the output image holding medium being conveyed by the output image holding medium conveying belt is contactable with the first toner image formed by the firs image forming mechanism, for transferring the first toner image to the output image holding medium;

a second transfer device, provided at such a position that the output image holding medium being conveyed by the output image holding medium conveying belt is contactable with the second toner image formed by the second image forming mechanism, for transferring the second toner image formed by the second image forming mechanism onto the output image holding medium to be superposed onto the first toner image; and a fixing device including: a first rotation member formed hollow cylindrical and rotatable in a predetermined direction; a second rotation member brought into contact with the first rotation member at a predetermined pressure, so as to be rotated as the first rotation member rotates, creating a contact section with the first rotation member, through which an object to be heated can pass; a first induction heating device, provided within the first rotation member, for applying an alternating magnetic field which in a direction parallel to an axial line of the first rotation member, onto the first rotation member; and a second induction heating device, provided within the first rotation member such as to surround an outer section of a part of the first induction heating device, and be close to both end portions of the first rotation member, for applying an alternating magnetic field which is in parallel with a circumferential direction of the first rotation member, onto the first rotation member, the fixing device heating the output image holding medium on which the first and second toner images have been transformed, and the toners which form the toner images, thereby fixing the toner on the output image holding medium. device, and be close to both end portions of the first rotation member, for applying an alternating magnetic field which is in parallel with a circumferential direction of the first rotation member, onto the first rotation member, the fixing device heating the output image holding medium on which the first and second toner images have been transformed, and the toners which form the toner images, thereby fixing the toner on the output image holding medium.

Further, according to the present invention, there is provided a heating apparatus comprising:

a heat roller made of a pure iron hollow cylinder, and having an outer circumferential surface for giving heat and a pressure to a material to be heated, which is brought into contact with the outer circumferential surface;

a first magnetic coil, provided within the heat roller such that a direction of a conductor of a main portion of its coil, is directed in a direction parallel to an axial line of the heat roller, for creating an induction current in the heat roller; and a second magnetic coil, provided within the heat roller such that a direction of a conductor of a main portion of its coil, is directed in a direction parallel to a circumferential direction of the heat roller, for creating an induction current in the heat roller.

DETAILED DESCRIPTION OF THE INVENTION

A color image forming apparatus in which a fixing device of the present invention is built will now be described in detail with reference to accompanying drawings.

Figure 1:
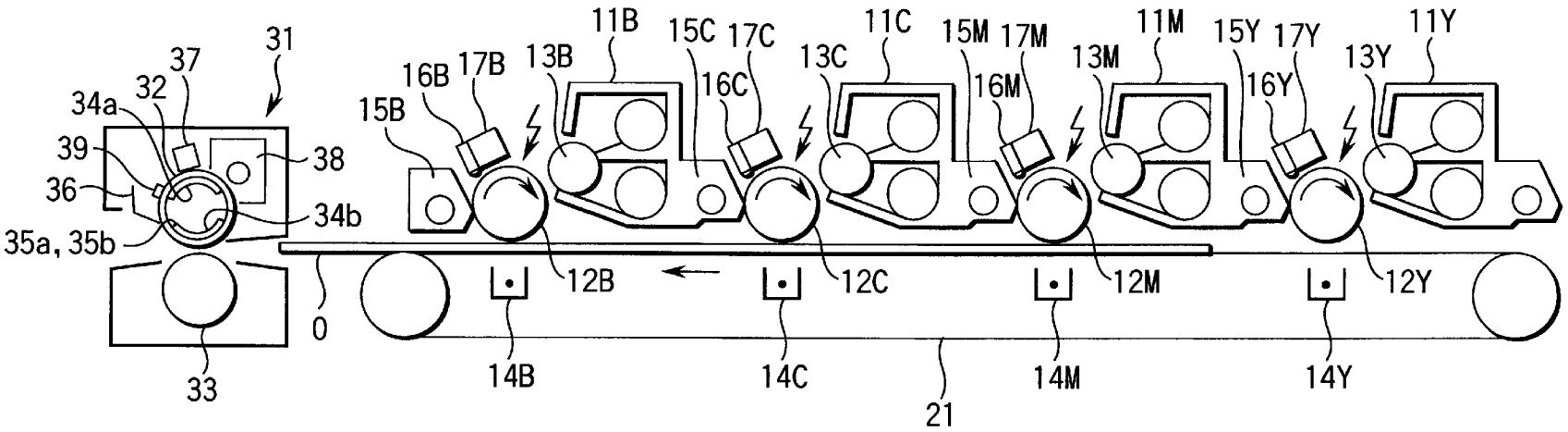
FIG. 1 is a schematic diagram showing an example of a color image forming device in which a fixing device of the present invention is built.

FIG. 1 is a schematic diagram illustrating a color image forming device which contains a fixing device according to the present invention.

As shown in FIG. 1, a color printer (color image forming apparatus) 101 includes first, second, third and fourth image forming units 11Y, 11M, 11C and 11B for forming 4 (4 colors) images on the basis of four printing signals of yellow (Y), magenta (M), cyan (C) and black (B), which are color-separated in accordance with subtractive primaries maintained by a printing signal holding unit, which is not shown. These image forming units are arranged at predetermined intervals between adjacent pairs, along an endless belt (transfer belt) 21 with a predetermined distance away with respect to the transfer belt, for conveying sheet paper serving as a transfer material (image output medium) and a sheet material made of a transparent resin, used for an overhead projector.

The image forming units 11Y, 11M, 11C and 11B respectively have photosensitive drums 12Y, 12M, 12C and 12B for forming latent images as image light (exposure light) is irradiated from an image exposure unit (not shown) onto the photosensitive drums while a predetermined potential, for example, a voltage of −500 v is being given thereto. It should be noted that each of the photosensitive drums is an aluminum-made hollow cylinder having a diameter of, for example, 30 mm, on a surface of which an organic photosensitive layer having a thickness of about 20 $\mu$m (not shown) is provided. The photosensitive layer has such characteristics that at normal state, it exhibits a high resistance, but when irradiated with light, the resistivity of the light-irradiated portion decreases, and exhibits similar properties to those of conductors. Further, each of the photosensitive drums is rotated by means of a driving mechanism (not shown) in a CW direction at a moving speed of its circumferential surface of 50 mm/sec.

Such as to surround the photosensitive drums 12Y, 12M, 12C and 12B, there are provided by a certain order and arrangement, development devices 13Y, 13M, 13C and 13B for forming a Y toner image, M toner image, C toner image and B toner image, respectively, by selectively supplying toners colored in Y, M, C and B, onto latent images formed on the photosensitive drums. Further, there are provided transfer devices 14Y, 14M, 14C and 14B, and the like, for transferring the toner images formed on the photosensitive drums onto a transfer material O through attraction by the static electricity. It should be noted here that each of the development devices is a two-component type development device which uses conventional two-component developer. Further, each transfer device is disposed such as to sandwich a transfer belt (endless belt) 21 between the respective photosensitive drum and itself.

Further, such as to surround the photosensitive drums 12Y, 12M, 12C and 12B, there are provided in a similar manner to that of the above, cleaners 15Y, 15M, 15C and 15B for removing toner still remaining on the surface of the photosensitive drums after the toner images have been transferred onto the sheet material O, erasing devices 16Y, 16M, 16C and 16B for discharging remaining charge on the photosensitive drums after the toner has been cleaned by the cleaners 15Y, 15M, 15C and 15B, and charging devices 17Y, 17M, 17C and 17B for charging the photosensitive drums at a predetermined potential. It should be noted that each cleaner has a blade (not shown) made of, for example, urethane rubber. As the blade is made contact with the surface of the photosensitive drum at a predetermined pressure, the remaining toner is wiped off from the drum surface, and collected in a toner waste portion (not shown). Thus collected toner is discarded by the user or a service maintenance person, when the amount of the collected toner reaches a predetermined level. Meanwhile, each erasing device radiates light of such a predetermined wavelength that can short-circuit the photoconduction layer of the respective photosensitive drum.

The transfer belt 21 is made of a conductive urethane rubber material having a thickness of about 0.5 mm, and is looped over first and second rollers 22 and 23. Thus, as one of these rollers rotates, an arbitrary position of the transfer belt 21 moves in a predetermined direction. It should be noted that the direction in which the transfer belt 21 moves is the direction from the first image forming unit 11Y towards the fourth image forming unit 11B with regard to the side close to the image forming units. Further, on a back surface side ( which is the side brought into contact with the two rollers) of the transfer belt 21, there is provided a charge device 24 which applies a predetermined potential to the transfer belt 21 so as to attract the medium O supplied from an image output medium feeding unit (not shown) to be attached onto the transfer belt 21.

In the front side of the roller 23 in the direction where the medium O is conveyed by the transfer belt 21, a fixing device 31 is provided for fixing the four toner images held on the image output medium O onto the medium itself.

The fixing device 31 includes a first roller (heat roller) 32 of a pure-iron-made cylinder having a thickness of about 1 mm, a diameter of about 40 mm and a length of 340 mm, and a second roller (press roller) 33 of a cylinder having a diameter of about 40 mm and a length of 340 mm, as in the first roller, and arranged to be in parallel with an axial line of the first roller 32 and along the longitudinal direction of the first roller, and brought into contact with one point on the circumference of the first roller 32. The surface of the first roller 32 is coated with a mould releasing layer made of a fluorocarbon resin such as polytetrafluororthylene (known as a tradename of Teflon) so as to suppress attachment of toner. Further, the second roller 33 is an elastic roller made of a shaft having a predetermined diameter, whose circumference is covered by a material such as silicon rubber or fluorine rubber.

It should be noted here that the rollers are pressed to be against each other by a press mechanism (not shown) at a predetermined pressure, and thus the press roller has a nip region which is temporarily deformed as a result. The heat roller 32 is rotated at a constant speed so that it (actually, the outer circumferential surface of itself) moves at approximately the equal speed to that of the outer circumference of the photosensitive drum of each image forming unit. Further, as the heat roller 32 is rotated, the press roller 33 is rotated in such a manner that the moving speed of the outer circumferential surface of the press roller is equal to the moving speed of the outer circumferential surface of the heat roller.

In an inner side of the first roller 32, first and second induction coils 34*a* and 34*b* are provided along an inner wall of the first roller 32, and third and fourth induction coils 35*a* and 35*b* are provided at two end portions of the first roller 32 such as to surround outer sides of the first and second induction coils 34*a* and 34. It should be noted that the first and second coils 34*a* and 34*b* are built such as to keep a gap of approximately 1.5 mm with respect to the inner surface of the roller 32 in a central vicinity of the heat roller 32 in its longitudinal direction. Further, the third and fourth coils 35*a* and 35*b* are provided to start from a position about 5 mm from the both end portion of the heat roller 32, over a width of 40 mm. In this case, the gap between the third and fourth coil 35*a* or 35*b* and the inner surface of the roller 32 is defined to approximately 1.5 mm. Therefore, the gap between the first and second coils 34*a* and 34*b* and the inner surface of the roller 32 in a section where the third and fourth coils 35*a* and 35*b* are arranged, and in its vicinity is defined to approximately 3.0 mm.

Each coil is an air-core coil, which does not have a core, and is formed from a litz wire in which 19 copper wires each having a wire diameter of 0.5 mm and coated with a heat-resisting insulator (polyimide insulator) are bundled together. Each coil is held at a predetermined position by means of a supporting member (not shown) made of heat-resisting engineering plastics and a holder (not shown) used for define the position of the supporting member in the roller.

On the surface of the first roller 32, there are provided a peel-off nail 36 for peeling the image output medium O from the first roller 32, a release agent applying device 37 for applying a releasing agent (oil) which serves to prevent toner from attaching to the surface of the roller 32, a cleaner 38 for cleaning the surface of the first roller 32, and the like in a predetermined order in the rotational direction of the roller. Further, at a predetermined position on the surface of the first roller 32, a thermistor 39 used to detect the temperature of the roller is provided.

Figure 2:
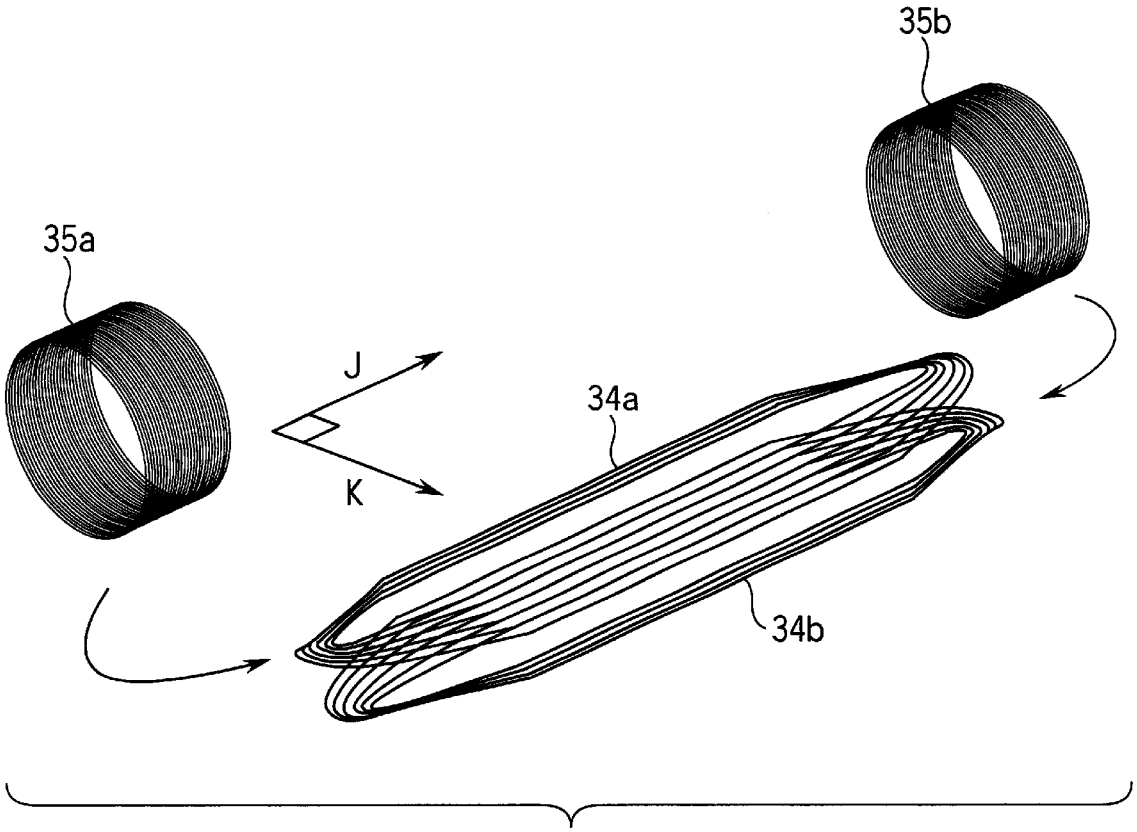
FIG. 2 is a schematic diagram illustrating a shape and arrangement of induction coils of a fixing device of an induction heating type, built in an image forming device shown in FIG. 1.

FIG. 2 is a schematic diagram illustrating the shape and arrangement of the induction coil built in the fixing device of an induction heating type, of the image forming device (color printer) which is illustrated with reference to FIG. 1.

As shown in FIG. 2, the first and second coils 34*a* and 34*b* of the fixing device 31 are provided along an inner side of the heat roller (the first roller) over substantially the entire region (entire length) of the roller 32 in the longitudinal direction. These coils are arranged along the inner wall of the roller 32 in such a manner that the roller 32 is divided approximately equally into two in its circumferential direction. Each of the coils 34*a* and 34*b* is formed such that the diameter thereof becomes smaller gradually as compared to the inner diameter of the roller 32 as it gets closer to the end portion in a vicinity of the end portion of the roller 32 in its longitudinal direction, as well as the circumference thereof becomes narrower gradually as it gets closer to the end portion of the roller with regard to the circumferential direction of the roller 32. The winding direction of each coil is the longitudinal direction of the roller 32, and it is turned back in the circumferential direction of the roller 32.

The third and fourth coils 35*a* and 35*b* are provided two sections, that is, both end portion of the roller 32 in its longitudinal direction. The coils 35*a* and 35*b* are arranged on outer sides to the first and second coils 34 and 34*b*, respectively. The winding direction of the third and fourth coils 35*a* and 35*b* is the circumferential direction of the roller 32.

Figure 3:
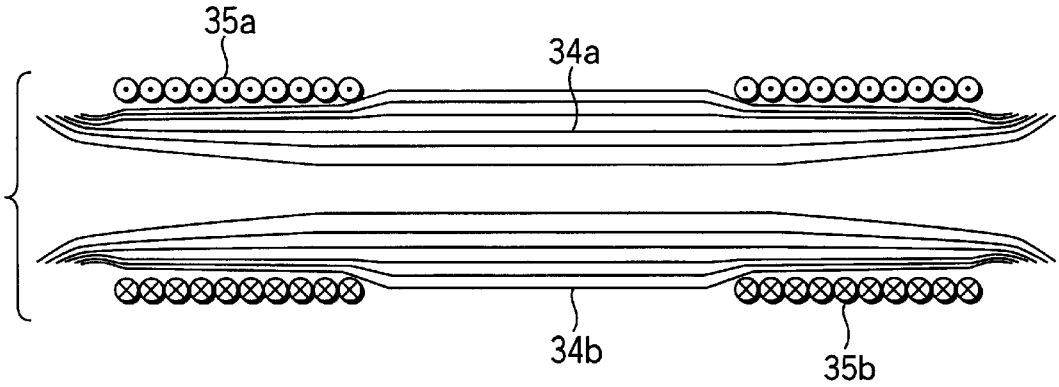
FIG. 3 is a lateral view of induction coils shown in FIG. 2.

FIG. 3 is a schematic diagram illustrating the induction coils described with reference to FIG. 2, as they are viewed from the side surface of the roller (that is, the direction orthogonal to the longitudinal direction as well as parallel to the cross sectional direction).

As can be seen in FIG. 3, in the first and second coils 34*a* and 34*b*, the diameter of the circular made in each coil gradually decreases as compared to the inner diameter of the roller 32 as it gets closer to the end portion in a vicinity of the end portion of the roller 32 in its longitudinal direction. In the circumferential direction as well, the size of the circumference thereof becomes narrower gradually as it gets closer to the end portion of the roller with regard to the circumferential direction of-the roller 32. It is also confirmed that the third and fourth coils 35*a* and 35*b* are located on the outer sides of the first and second coils 34*a* and 34*b*, and are wound in the circumferential direction of the roller 32.

With regard to the four coils 34*a*, 34*b*, 35*a* and 35*b* shown in FIGS. 2 and 3, the direction of the first magnetic flux J (magnetic flux vector) created by the current flowing in the third and fourth coils 35*a* and 35*b* are set in parallel with the axial direction of the heat roller 32, and set in parallel with axial direction as well within the cylinder of the heat roller 32.

The direction of the second magnetic flux K (magnetic flux vector) created by the current flowing in the first and second coils 34*a* and 34*b* are gradually directed in a circumferential direction of an inner surface of the cylinder of the roller 32 as the frequency is raised, since the direction of the current is set in the axial direction. Therefore, within the cylinder of the heat roller 32, two types of magnetic fluxes substantially perpendicular to each other, provided by the four coils of the two pairs create induction currents which are perpendicular to each other. With this structure, the induction currents supplied form the four coils do not interfere with each other. In this case, the phase differences between these induction currents are negligible since the directions of the induction currents are orthogonal to each other.

For this reason, the decrease in the density of the induction current, which is a factor of the temperature of both end portions of the heat roller 32 not easily increasing, can be prevented (that is, the output of the induction power, which causes an influence on both ends of the roller can be substantially increased), and the decrease in the temperature in the both end portions of the roller can be suppressed.

In detail, when an alternate current of the first and second coils 34*a* and 34*b* is represented by:

$$I_1=I_{max}_1\ \cos(WT),$$

the induction current density at an arbitrary position within the heat roller 32 is expressed by:

$$J_{eddy}1=J_0_1\ \cos(WT+A)$$

where

W denotes a drive current frequency;

T denotes time, and

A denotes a function of position. It should be noted here that $J_{eddy}1$ is a current density vector, which flows in the vicinity of the surface layer of the inner surface of the roller 32 under the above described conditions. Further, the direction of $J_{eddy}1$ is within a surface perpendicular to the magnetic flux K, and directed to the axial direction of the roller 32.

In contrast, when an alternate current of the third and fourth coils 35*a* and 35*b* is represented by:

$$I_2=I_{max}_2\ \cos(WT),$$

the induction current density at the same position as where the induction current density of the first and second coils 34*a* and 34*b* within the heat roller 32 is examined is expressed by:

$$J_{eddy}2=J_0_2\ \cos(WT+B)$$

where

W denotes a drive current frequency;

T denotes time, and

A denotes a function of position. It should be noted here that $J_{eddy}2$ is a vector, which flows in the vicinity of the surface layer of the inner surface of the roller 32 under the above described conditions. Further, the direction of $J_{eddy}2$ is within a surface perpendicular to the magnetic flux K, and directed to the circumferential direction of the roller 32.

In each of these cases, the joule loss in the eddy current is:

$$W1(\text{watt})=\int(J_{eddy}1^2/\sigma)dV, \text{ and}$$

$$W2(\text{watt})=\int(J_{eddy}2^2/\sigma)dV,$$

where σ denotes an electric conduction degree of a steel material (pure iron) which constitutes the roller. It should be noted that in these equations, $J_{eddy}1$ and $J_{eddy}2$ are in absolute values.

The output thereof will be in time-average of the volume integration of these equations. Note that in the present invention, it is possible to superpose the effect due to the first and second coils 34*a* and 34*b*, and the effect due to the third and fourth coils 35*a* and 35*b*, and therefore the entire current density will be expressed by:

$$J_{eddy}1+J_{eddy}2$$

It should be noted here that when the phases A and B differ from each other, the absolute value of the entire current is generally affected; however in the present invention, $J_{eddy}1$ and $J_{eddy}2$ are directed at right angles with each other, the phases A and B are not influenced (the phase difference can be neglected).

Therefore, the sum of wattages of these outputs will not be reduced.

The first, second third and fourth induction coils 34*a*, 34*b*, 35*a* and 35*b* shown in FIGS. 2 and 3, serve to generate an induction current in the substantial portion of the roller 32 (in its main body) with the magnetic flux 1 generated by two types of high-frequency currents supplied independently from an excitation circuit (inverter circuit) not shown, in a direction in which the variation of the magnetic flux 1 is inhibited. Further, the alternate currents flowing in the coils 34*a*, 34*b*, 35*a* and 35*b* flow in the roller 32 if the driving frequency becomes higher than a predetermined level, and therefore the magnetic field H within the roller 32 varies along the circumferential direction of the cylindrical surface of the roller 32. It should be noted here that a high-frequency current having a frequency of 25 kHz and 60 A is supplied to the four coils. The total output here is about 900 W.

Due to the induction current and the electric resistance of the heat roller 32, joule heat is generated, and the heat roller 32 generates heat (the roller is heated).

Additionally, as described before, the heat roller 32 is made of pure iron, and therefore hysteresis heat loss occurs at the same time in addition to the joule heat loss.

Figure 4:
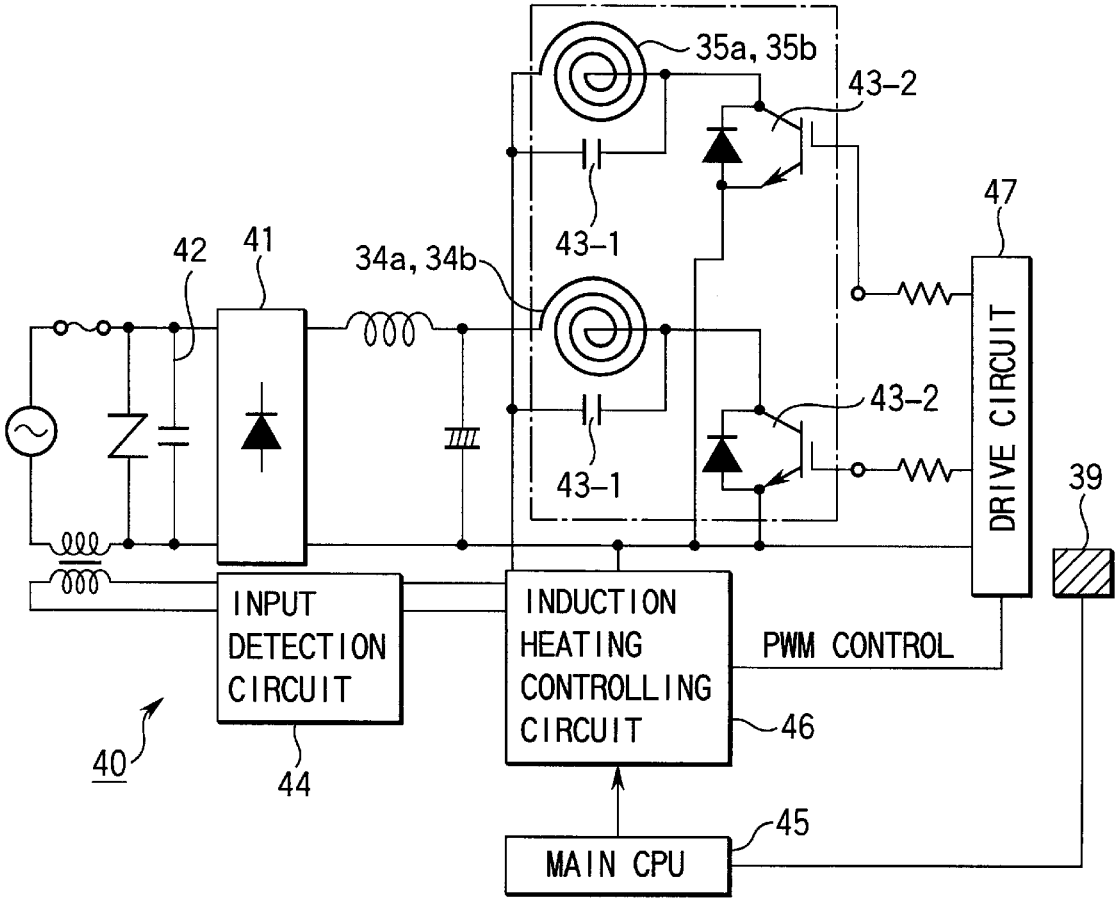
FIG. 4 is a block diagram illustrating a drive circuit for driving a fixing device shown in FIG. 2 and 3.

FIG. 4 is a block diagram illustrating a driving circuit for driving the fixing device shown in FIGS. 2 and 3.

As can be seen in FIG. 4, a driving circuit 40 serves to supply a current obtained by rectifying an alternating current of a commercial power source by a rectifying circuit 41 and a smooth capacitor 42, to the first and second coils 34*a* and 34*b* and the third and fourth coils 35*a* and 35*b*, via an inverter circuit 43 (oscillating capacitors 43-1 and 43-1, and switching circuits 43-2 and 43-2). It should be noted that a high-frequency current is detected by the input detection circuit 44. Further, the temperature of the surface of the roller 32, detected by the thermister 39 is converted into a digital signal by an A/D converter (not shown), and the signal is input to a main controller CPU 45. From the CPU 45, an ON/OFF instruction converted into an analog value by a D/A converter (not shown) is supplied to an IH (induction heat) circuit 46. During this period, the driver circuit 47 is controlled by, for example, PWM (pulse width modulation) so as to obtain a designated output value. It should be noted here that the output value designated can be controlled by varying the time period when the switching element 43*c* of the inverter circuit 43 is on, at an arbitrary timing. Here, the driving frequency is varied to an arbitrary frequency.

The switching circuits 43-2 and 43-2 can be replaced by conventionally known IGBT (insulated gate bipolar transistor).

It is further known that if the frequency W of a high-frequency current supplied to each coil is lowered, the induction current is reduced accordingly, and therefore the output becomes small as well.

It should be noted that FIG. 4 illustrates an example where the first and second coils 34*a* and 34*b*, and the third and fourth coils 35*a* and 35*b* are driven by a common inverter circuit. If these coils (a pair of 34*a* and 34*b*, and a pair of 35*a* and 35*b*) are driven by independent driving circuits, they do not always have the same frequency W. The frequency W is usually 25 KHz, and in the case where the end portion of the heat roller 32 does not have to be heated, a high-frequency current of, for example, 6 kHz, is supplied to each of the third and fourth coils 35*a* and 35*b*.

Figure 5:
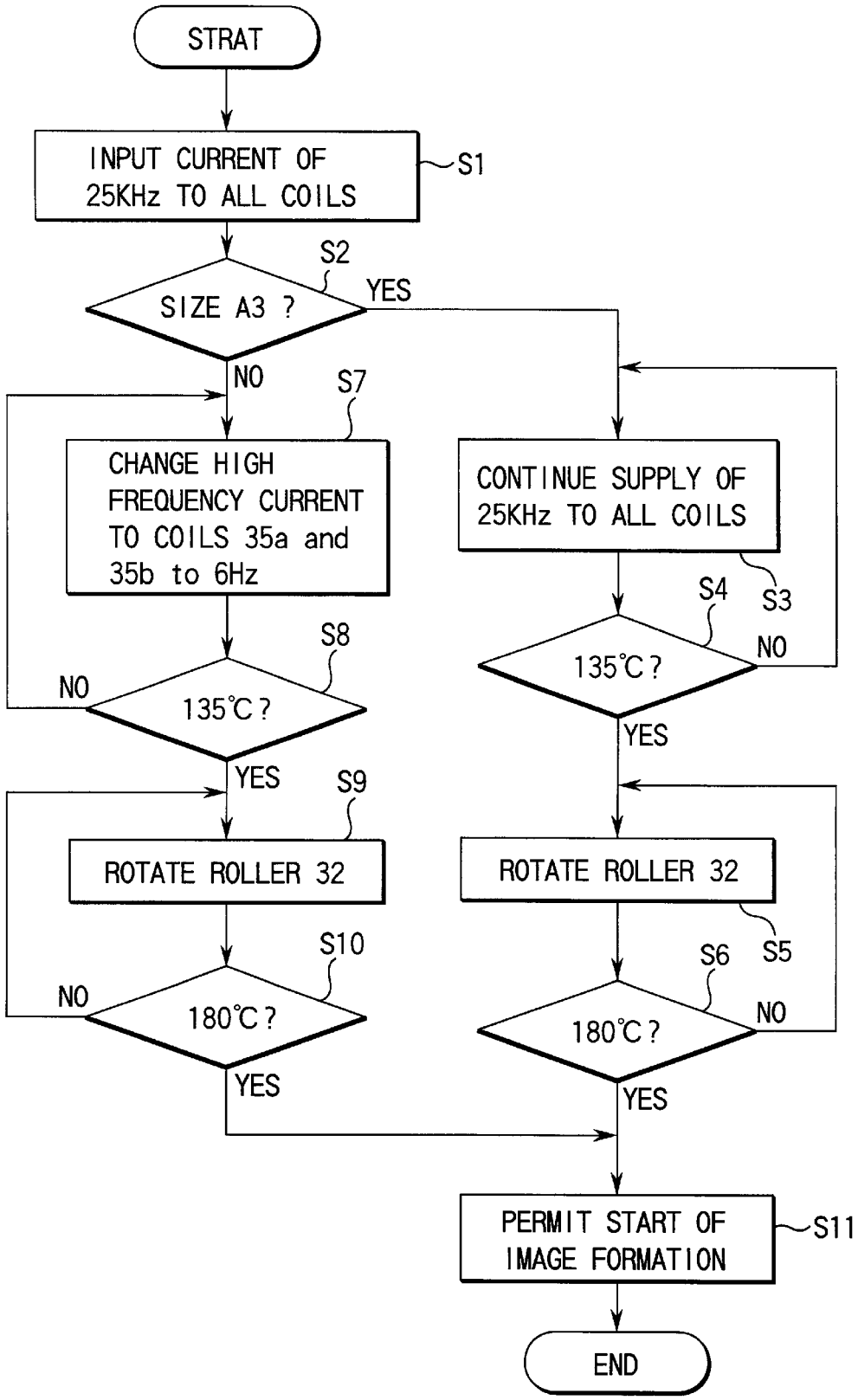
FIG. 5 is a flowchart illustrating the operation of the fixing device shown in FIGS. 2 to 4.

FIG. 5 is a flowchart illustrating the operation of the fixing device shown in FIGS. 2 to 4.

For example, immediately after the main switch of the image forming device is turned on, the most of the input power can be utilized for the heating of the roller (the electricity supply to the induction coil). Here, the maximum power is supplied to each of the first and second coils 34*a* and 34*b*, and the third and fourth coils 35*a* and 35*b* (S1).

When the data of an image to be output and the size of the sheet are input to an image memory (not shown), the supply of electricity to the first and second coils 34*a* and 34*b* and the third and fourth coils 35*a* and 35*b* is controlled in accordance with the size of the sheet (S2-Y, S2-N, S3 and S4). More specifically, when the sheet size is of A3 (B4 size), the maximum suppliable power is supplied to each of the coils in order to heat the entire region of the roller 32 in the longitudinal direction as indicated in step S3. On the other hand, in the case where the sheet size is A4, and the sheet is conveyed in such a manner that the short side is orthogonal to the conveying direction (which is called A4 longitudinal direction), the frequency of the high-frequency current supplied to the third and fourth coils 35*a* and 35*b* is lowered to, for example, 6 kHz (S4).

From then, until it is detected by the thermister 39 that the temperature of the surface of the roller 32 has reached a predetermined temperature, a predetermined power is supplied to each of the coils. Further, at the point when the temperature of the surface of the roller reaches the first temperature, for example, 135° C., the driving circuit (not shown) is turned on, and the heat roller 32 is rotated. After that, until the thermister 39 detects a predetermined temperature, for example, 180° C., the predetermined power is continuously supplied to the coils (S5, S6, S7 and S8).

In step S8, when it is detected that the temperature of the surface of the roller 32 has reached a predetermined temperature, a start enabling signal, which permits an image forming operation, is output (S9).

It should be noted that in each step, the instruction value is varied, for example, at the same time as the roller starts to rotate, or immediately before, so that the power supplied to each respective coil does not exceed the allowance value.

The length in the axial direction of the surface of the heat roller 32, which is heated by the first and second coils 34*a* and 34*b*, is the same as the width of an A4 sheet in the longitudinal direction. In the case where the size of the sheet is A4 in the longitudinal direction in step S4, the frequency W of the high-frequency current applied to the third and fourth coils 35*a* and 35*b* which correspond to both end portions of the heat roller 32 is reduced to 6 kHz, and thus the power consumed by both coils is reduced to about 100 W. Here, the consumption power for heating the region of the heat roller 32, which corresponds to the width of the longitudinal A4 size, is about 600 W.

Therefore, when forming an image on an image output medium O having a width narrower than the length of the heat roller 32 in the axial direction, the heating can be selectively done with respect to the length direction of the heat roller, and therefore the loss of energy can be suppressed.

It should be noted that when the size of the image forming medium corresponds to the longitudinal A4 size, when the frequency of the high-frequency current supplied to the third and fourth coils 35*a* and 35*b* at a predetermined timing and a predetermined cycle is increased to a predetermined frequency, the temperature of the entire region of the heat roller 32 is raised temporarily and therefore the heat being released from the center portion (of the roller) to the end portion can be prevented, thereby making it possible to improve the fixing property. This also helps in suppression of the total consumption power. In this case, a high-frequency current of, for example, 25 kHz, is supplied to the third and fourth coils 35*a* and 35*b* at a predetermined cycle. It should be noted that the consumption power consumed due to the increase in the frequency of the high-frequency current is about 300 W.

Figure 6:
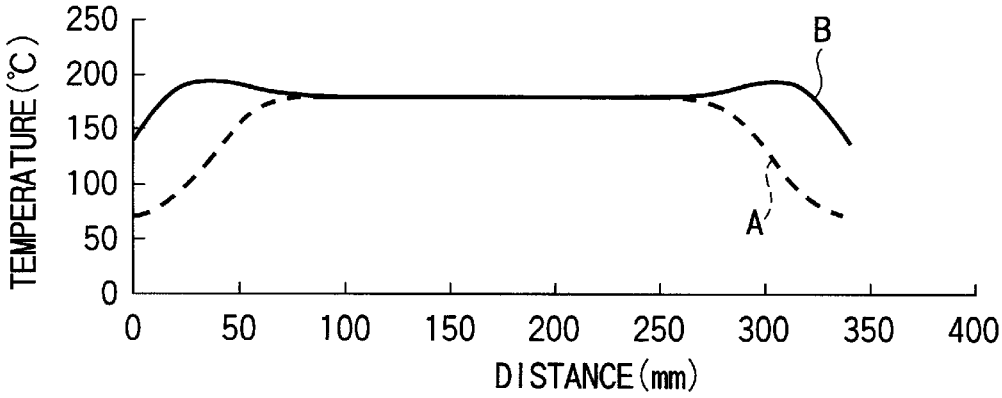
FIG. 6 is a graph illustrating a temperature distribution of the heat roller in its longitudinal direction, which is provided by the induction coils shown in FIGS. 2 and 3.

FIG. 6 is a graph illustrating the temperature distribution of the heat roller in its longitudinal direction, which is supplied by the induction coils shown in FIGS. 2 and 3.

In FIG. 6, the curve A indicates a temperature distribution of the heat roller 32 in the longitudinal direction in the case where an electrical power is supplied to the first and second coils 34*a* and 34*b* only, whereas the curve B indicates a temperature distribution of the heat roller 32 in the longitudinal direction in the case where an electrical power is supplied to all of the coils. It should be noted that the temperature distribution shown in FIG. 6 is a result of the supply of a current of 60 A to each coil.

As is clear from FIG. 6, in addition to the first and second coils, the third and fourth coils are provided at positions corresponding to the end portions of the heat roller 32, and thus substantially a uniform surface temperature can be achieved at an entire region of the heat roller in the longitudinal direction.

As described above, the fixing device of the color image forming apparatus of the present invention extends out in the axial direction of the roller, and has a first coil in which the direction of the current flowing within itself coincides with the axial direction of the roller, and a second coil wound around an end portion in the longitudinal direction of the roller, along the circumferential direction of the roller, in which the direction of the current flowing within itself coincides with the circumferential direction of the roller. With this structure, the directions of the magnetic fields created by the currents flowing through the coils are set to cross each other. Therefore, all of the induction currents generated in the roller are made to contribute to the heat generation of the roller. In this manner, the heat efficiency can be increased, and the consumption power is reduced.

Further, the currents flowing through the first and second coils can be set independently, and therefore toner can be surely fixed onto an output image carrier medium while the consumption power is controlled in accordance with the size of the medium which stores the output image.

Furthermore, in the case where the width of the medium which carries the output image is less than the length of the heat roller, the frequency of the high-frequency current flowing through the second coil is increased periodically, so as to heat the temperature of the end portion in the longitudinal direction of the roller. In this manner, while suppressing the decrease in the temperature of the end portion of the roller in the longitudinal direction, toner can be surely fixed onto an output image carrier medium at a low consumption power.

What is claimed is:

1. A fixing device comprising:

a first rotation member formed to be a hollow cylinder and rotatable in a predetermined direction;

a second rotation member brought into contact with said first rotation member at a predetermined pressure, so as to be rotated as said first rotation member rotates, creating a contact section with said first rotation member, through which an object to be heated can pass;

a first induction heating device, provided within said first rotation member, for applying an alternating magnetic field, which is in parallel with a circumferential direction of said first rotation member, onto said first rotation member; and a second induction heating device, provided within said first rotation member such as to surround an outer side of a part of said first induction heating device, and be close to both end portions of said first rotation member, for applying an alternating magnetic field which is in a direction parallel to an axial line of said first rotation member, onto said first rotation member.

2. A fixing device according to claim 1, wherein said first induction heating device is a magnetic coil having a conductor as main part thereof, which is directed in an axial direction of said first rotation member.

3. A fixing device according to claim 2, wherein the magnetic coil is a coil in which a litz wire is arranged in a plan manner, and is arranged along an inner circumference of said first rotation member.

4. A fixing device according to claim 1, wherein said second induction heating device is a magnetic coil which uses a litz wire, and has a conductor as main part thereof, which is directed in an axial direction of said first rotation member.

5. A fixing device according to claim 1, wherein in both end portions of said first rotation member, a magnetic field provided by said first induction heating device and a magnetic field provided by said second induction heating device cross with each other at about 90°.

6. A fixing device according to claim 1, wherein an end portion in a longitudinal direction of said first induction heating device is formed to have an outer diameter smaller than that of a central portion of said first induction heating device so as to be able to mount said second induction heating device.

7. A fixing device according to claim 6, wherein said second induction heating device is provided to interpose an insulating gap between itself and said first induction heating device.

8. A fixing device according to claim 6, wherein said first induction heating device uniformly heats regions at predetermined intervals from the central portion of said first rotation member in the longitudinal direction.

9. A fixing device according to claim 8, wherein said second induction heating device uniformly heats regions at predetermined intervals from the central portion of said first rotation member in the longitudinal direction, and suppress heat of said first rotation member heated by said first induction heating device from being released to an end portion in the longitudinal direction of said first rotation member.

10. A color image forming apparatus comprising:

a first image forming mechanism for forming a first toner image by selectively supplying a toner of a first color onto a first photosensitive drum and a latent image formed on the first photosensitive drum;

a second image forming mechanism for forming a second toner image by selectively supplying a toner of a second color, which is different from the toner of the first color, onto a second photosensitive drum and a latent image formed on the second photosensitive drum;

an output image holding medium conveying belt for holding an image holding medium and conveying the output image holding medium from the first image forming mechanism towards the second image forming mechanism such taht the first and second toner images formed by the first and second iamge forming mechanisms, respectively are made transferable onto the output image holding medium;

a first transfer device, provided at such a position that the output image holding medium being conveyed by the output image holding medium conveying belt is contactable with the first toner image formed by the first image forming mechanism, for transferring the first toner image to the output image holding medium;

a second transfer device, provided at such a position that the output image holding medium being conveyed by the output image holding medium conveying belt is contactable with the second toner image formed by the second image forming mechanism, for transferring the second toner image formed by the second image forming mechanism onto the output image holding medium to be superposed onto the first toner image; and a fixing device including: a first rotation member formed hollow cylindrical and rotatable in a predetermined direction; a second rotation member brought into contact with the first rotation member at a predetermined pressure, so as to be rotated as the first rotation member rotates, creating a contact section with the first rotation member, through which an object to be heated can pass; a first induction heating device, provided within the first rotation member, for applying an alternating magnetic field which is in parallel with a circumferential direction of the first rotation member, onto the first rotation member; and a second inducting heating device, provided within the first rotation member such as to surround an outer section of a part of the first induction heating device, and be close to both end portions of the first rotation member, for applying an alternating magnetic field which is in direction parallel to an axial line of the first rotation member, said fixing device heating the output image holding medium on which the first and second toner images have been transformed, and the toners which form the toner images, thereby fixing the toner on the output image holding medium.

11. A color image forming apparatus according to claim 10, wherein said first induction heating device of said fixing device of said color image forming apparatus is a magnetic coil having a conductor as main part thereof, which is directed in an axial direction of said first rotation member.

12. A color image forming apparatus according to claim 10, wherein said second induction heating device of said fixing device of said color image forming apparatus is a coil in which a litz wire is arranged in a plan manner, and is arranged along an inner circumference of said first rotation member.

13. A color image forming apparatus according to claim 10, wherein an end portion in a longitudinal direction of said first induction heating device of said fixing device of said color image forming apparatus is formed to have an outer diameter smaller than that of a central portion of said first induction heating device so as to be able to mount said second induction heating device.

14. A color image forming apparatus according to claim 10, wherein said first induction heating device of said fixing device of said color image forming apparatus uniformly heats regions at predetermined intervals from the central portion of said first rotation member in the longitudinal direction.

15. A color image forming apparatus according to claim 14, wherein said second induction heating device of said fixing device of said color image forming apparatus uniformly heats regions at predetermined intervals from the central portion of said first rotation member in the longitudinal direction, and suppress heat of said first rotation member heated by said first induction heating device from being released to an end portion in the longitudinal direction of said first rotation member.

16. A heating apparatus comprising:

a heat roller made of a pure iron hollow cylinder, and having an outer circumferential surface for giving heat and a pressure to a material to be heated, which is brought into contact with the outer circumferential surface;

a first magnetic coil, provided within the heat roller such that a direction of a conductor of a main portion of its coil, is directed in a direction parallel to an axial line of the heat roller, for creating an induction current in the heat roller; and a second magnetic coil, provided within the heat roller such that a direction of a conductor of a main portion of its coil, is directed in a direction parallel to a circumferential direction of the heat roller, for creating an induction current in the heat roller.

* * * * *